United States Patent [19]

Ott et al.

[11] Patent Number: 4,665,687

[45] Date of Patent: May 19, 1987

[54] SPINNING DEVICE FOR OPEN-END SPINNING

[75] Inventors: Ernst Ott, Flurlingen; Christoph Kuratle, Winterthur, both of Switzerland

[73] Assignee: Rieter Machine Works Limited, Winterthur, Switzerland

[21] Appl. No.: 918,132

[22] Filed: Oct. 14, 1986

[30] Foreign Application Priority Data

Oct. 10, 1985 [CH] Switzerland ..... 04434/85

[51] Int. Cl.[4] ..... D01H 7/882; D01H 1/135

[52] U.S. Cl. ..... 57/417; 57/414; 57/415

[58] Field of Search ..... 57/400, 404, 411, 414–417

[56] References Cited

U.S. PATENT DOCUMENTS

| | | | |
|---|---|---|---|
| 3,778,989 | 12/1973 | Schon | 57/417 |
| 3,789,597 | 2/1974 | Schon | 57/417 |
| 3,875,731 | 4/1975 | Khomyakov et al. | 57/417 |
| 4,258,541 | 3/1981 | Le Chatelier et al. | 57/417 |
| 4,458,477 | 7/1984 | Raasch et al. | 57/415 |
| 4,499,719 | 2/1985 | Faessler | 57/417 |
| 4,516,397 | 5/1985 | Raasch et al. | 57/417 |
| 4,610,134 | 9/1986 | Busch et al. | 57/417 |

FOREIGN PATENT DOCUMENTS

| | | |
|---|---|---|
| 129036 | 9/1968 | Czechoslovakia . |
| 3220402 | 3/1985 | Fed. Rep. of Germany . |
| 2262137 | 9/1975 | France . |
| 2127442 | 4/1984 | United Kingdom . |

*Primary Examiner*—John Petrakes

*Attorney, Agent, or Firm*—Werner W. Kleeman

[57] ABSTRACT

The spinning device for open-end spinning contains a withdrawal nozzle with a substantially spiral-shaped bead or ridge as well as a twist blocking element or twist trap containing beads or ridges and provided in a thread withdrawal passage. The inclinations of the substantially spiral-shaped bead or ridge and of the beads or ridges in the withdrawal nozzle and in the withdrawal passage, respectively, substantially extend in the same direction or sense as the twist of the yarn. This device permits increasing the stability of the yarn, reducing the number of thread breakages and/or increasing the production rate. The yarn characteristics are less dependent upon the fiber material and the yarn type. In particular, the production of yarns with a soft handle is rendered possible at higher rotor speeds than heretofore possible.

9 Claims, 4 Drawing Figures

SPINNING DEVICE FOR OPEN-END SPINNING

BACKGROUND OF THE INVENTION

The present invention relates to a new and improved construction of a spinning device for open-end spinning.

In its more particular aspects, the present invention specifically relates to a spinning device for open-end spinning and which spinning device contains a spinning rotor which is rotatable about a predetermined rotational axis, and a withdrawal arrangement for withdrawing the spun yarn or the like obtained by the open-end spinning operation.

In a spinning device for open-end spinning such as known, for example, from German patent No. 3,220,402 there is provided a withdrawal nozzle of the currently common construction which is combined with a balloon guide. The thread or yarn to be withdrawn forms a balloon in the balloon guide and the diameter of this balloon is subjected to multiple variations during each revolution thereof. Elements interfering with the balloon are provided and the thread impacts against such elements in order to induce thread or yarn formation. However, this is disadvantageous for the thread or yarn which is unduly stressed due to the plucking actions exerted upon the thread or yarn during this operation.

A withdrawal funnel as known, for example, from Czechoslovakian patent No. 129,036, granted Sept. 15, 1968, contains a projection which extends along a spiral-shaped path in a conical portion of the withdrawal funnel and along a helical path in a tubular portion of the withdrawal funnel. In such arrangement the projection exerts practically no effect upon the thread or yarn in the tubular portion and the overall effect is inadequate.

A spinning device for open-end spinning as known, for example, from U.S. Pat. No. 4,258,541, granted Mar. 31, 1981, contains a bent-off tube in which a wire is pressed against the internal surface of the tube. The wire has a plurality of turns for the purpose of temporarily increasing the twist level or twist in the thread. The provision of the multi-turn wire requires that the wire is manufactured from an elastic metal. A ceramic material, for example, can not be provided at such location.

It is known that the yarn or the like formed during an open-end spinning operation has lower hairiness and possesses a harder or firmer handle than a yarn which is produced by a ring spinning operation. While these properties are desirable for many purposes, they are particularly undesirable for the manufacture of knitted goods, i.e. knitted fabrics.

Therefore, attempts have been made to further develop the open-end spinning operation and open-end spinning equipment such that yarn or the like possessing a soft handle also can be produced. Since such yarns must be less strongly twisted, there exists the difficulty that in many cases, the yarns do not satisfy the demands imposed upon such yarns when employing an open-end spinning operation. This can result in substantial disadvantages such as insufficient yarn tensile strength and insufficient yarn evenness or uniformity, an excessive number of thick and thin places or neps at the yarn, or an intolerably high yarn or thread break rate.

SUMMARY OF THE INVENTION

Therefore, with the foregoing in mind it is primary object of the present invention to provide a new and improved construction of a spinning device or apparatus for open-end spinning and which spinning device or apparatus is not afflicted with the drawbacks and limitations of the prior art constructions heretofore discussed.

A further significant object of the present invention is directed to providing a new and improved construction of a spinning device for open-end spinning and which spinning device permits increasing the stability or strength of softly twisted yarns produced by the open-end spinning operation.

It is yet a further important object of the present invention to provide a new and improved construction of a device for open-end spinning and which spinning device permits a reduction in the yarn or thread break rate and an increase in the rotational speed of the rotor of the spinning device and thereby an increase in the production rate of softly twisted yarns during the open-end spinning operation.

Another noteworthy object of the present invention is directed to the provision of a new and improved construction of a spinning device for open-end spinning and which spinning device is intended to render the yarn properties or characteristics less dependent upon the fiber material used in the open-end spinning operation and the type of yarn produced by such open-end spinning operation.

Still another significant object of the present invention aims at a new and improved construction of a spinning device for open-end spinning and which spinning device renders possible the manufacture of soft handle yarns at spinning rotor speeds which are higher than the spinning rotor speeds presently used in open-end spinning machines.

In order to implement these and still further objects of the invention which will become more readily apparent as the description proceeds, the spinning device for open-end spinning of the present development is manifested by the features that, the withdrawal arrangement comprises a substantially funnel-shaped withdrawal nozzle containing at least one bead or ridge which extends along a substantially spiral-shaped path about the rotational axis of the spinning rotor and which is arranged at a conical portion or section of the funnel-shaped withdrawal nozzle. Such conical portion or section of the funnel-shaped withdrawal nozzle is slidingly contacted by the revolving yarn or the like during the open-end spinning operation. The withdrawal arrangement further comprises a twist blocking element or twist trap containing a thread withdrawal passage or channel. At least one bead or ridge arranged at an inclination relative to the longitudinal axis of the thread withdrawal passage or channel is present within the thread withdrawal passage or channel. The at least one bead or ridge is located in an arcuately shaped passage or channel section on the length of that half of the withdrawal passage or channel which faces the center of curvature associated with the arcuately shaped withdrawal passage or channel section. The at least one substantially spiral-shaped bead or ridge which is located in the withdrawal nozzle, and the at least one bead or ridge which is present in the arcuately shaped withdrawal passage or channel section, have an inclination substantially in the same direction as the direction of the twist of the spun yarn.

When using the inventive spinning device, the initially mentioned disadvantages of the prior art constructions can be avoided or at least appreciably minimized.

In addition, the combination of the at least one substantially spiral-shaped bead or ridge in the withdrawal nozzle and the at least one bead or ridge formed in the withdrawal passage or channel results in an improvement with respect to the tensile strength of the yarn, the number of thin places thereof, the number of thick places thereof and the number of neps thereof in comparison to the presently used open-end spinning operations. Variations in the yarn or thread tension and in the resistance to twisting are also reduced. The softness of the handle or the yarn or the like is markedly improved. Also, the provisions or facilities made in accordance with the present invention result in a construction possessing great durability and, at least in a particular embodiment containing a nozzle which is manufactured using a withdrawable core, in a construction which can be relatively simply fabricated.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
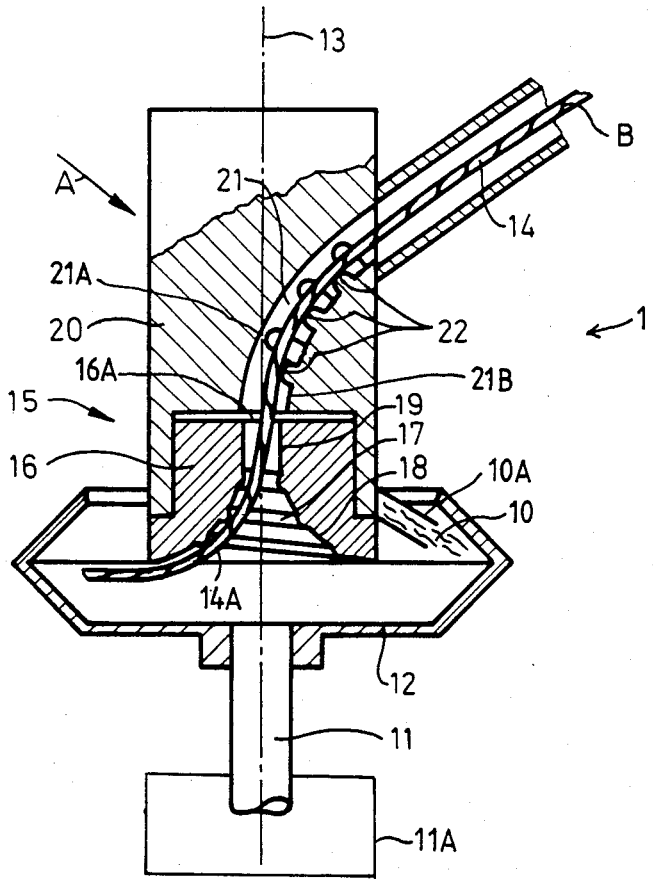
FIG. 1 is a longitudinal section through an exemplary embodiment of the inventive spinning device for open-end spinning.
Figure 2:
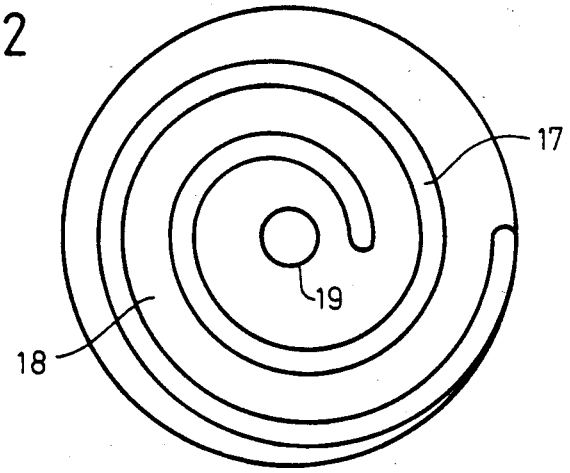
FIG. 2 is a bottom plan view of a withdrawal nozzle used in the spinning device for open-end spinning as shown in FIG. 1.

Describing now the drawings, it is to be understood that only enough of the construction of the exemplary embodiment of open-end spinning device has been shown as needed for those skilled in the art to readily understand the underlying principles and concepts of the present development, while simplifying the showing of the drawings. Turning attention now specifically to FIG. 1 of the drawings, there has been shown therein a longitudinal section through an exemplary embodiment of the inventive spinning device 1 for open-end spinning. In such open-end spinning device 1 a spinning rotor 12 is fixedly secured to a shaft 11. The shaft 11 and thereby the spinning rotor 12 are conjointly rotatable about a rotational axis 13 by means of any suitable rotary drive means llA. Fiber material 10 is infed into the interior of the spinning rotor 11 by way of a feed passage 10A. A revolving yarn or thread 14A or the like—hereinafter simply usually referred to as yarn—is formed during the open-end spinning operation and is yarn withdrawn through a yarn withdrawal arrangement 15 in order to thereby form a spun yarn 14.

The yarn withdrawal arrangement 15 contains a substantially funnel-shaped withdrawal nozzle 16 containing a substantially conical portion 18. An elongated projection, bead or ridge 17 or equivalent is confined to the substantially conical portion 18 and extends in a substantially spiral shape about the rotational axis 13 at the internal surface of the substantially conical portion 18 of the funnel-shaped withdrawal nozzle 16. In the illustrated exemplary embodiment, the substantially spiral-shaped bead 17 or the like constitutes a single-lead spiral. However, more than one substantially spiral-shaped bead, specifically beads or equivalent structure formed by multiple-lead spirals can also be used.

The substantially funnel-shaped withdrawal nozzle 16 further contains a tubular portion 19 having an internal surface 19A and communicating with said substantially conical portion 18 on the side or end thereof located remote from the spinning rotor 12. The internal surface 19A defines an imaginary or virtual cylinder 24, at best seen by referring to FIG. 3, which axially extends through said funnel-shaped withdrawal nozzle 16 as an extension of the internal surface 19A of the tubular portion 19.

The substantially spiral-shaped bead or ridge 17 which is confined to substantially conical portion 18 of the funnel-shaped withdrawal nozzle 16, extends throughout this substantially conical section 18 in such a manner that the substantially spiral-shaped bead or ridge 17 is located outside the aforementioned imaginary or virtual cylinder 24. Specifically, the substantially spiral-shaped bead or ridge 17 defines a surface 17A and a partial surface region 17B which faces the tubular portion 19 and which is structured such as to narrow or converge in the direction towards such tubular portion 19 of the funnel-shaped withdrawal nozzle 16. Instead, the partial surface region 17B which faces the tubular section 19, may also be structured such as to extend, at the maximum, substantially parallel to the imaginary or virtual cylinder 24 which extends from the internal surface 19A of the tubular portion 19 through the funnel-shaped withdrawal nozzle 16.

The substantially funnel-shaped withdrawal nozzle 16 and the substantially spiral-shaped bead 17 confined to the substantially conical portion 18 of the funnel-shaped withdrawal nozzle 16, preferably are manufactured from a ceramic material.

The withdrawal arrangement 15 further contains a twist blocking element or twist trap 20 possessing a tubular thread withdrawal passage or channel 21 communicating with an end 16A of the funnel-shaped withdrawal nozzle 16 and which end 16A is remote from the spinning rotor 12. The withdrawal passage or channel 21 defines a lengthwise axis 23 and contains a curved or arcuately shaped withdrawal channel section 21A associated with a predetermined center of curvature. The arcuately shaped withdrawal channel section 21A contains a withdrawal channel section half 21B, as seen in the direction of the lengthwise axis 23, on the side facing the predetermined center of curvature.

Figure 4:
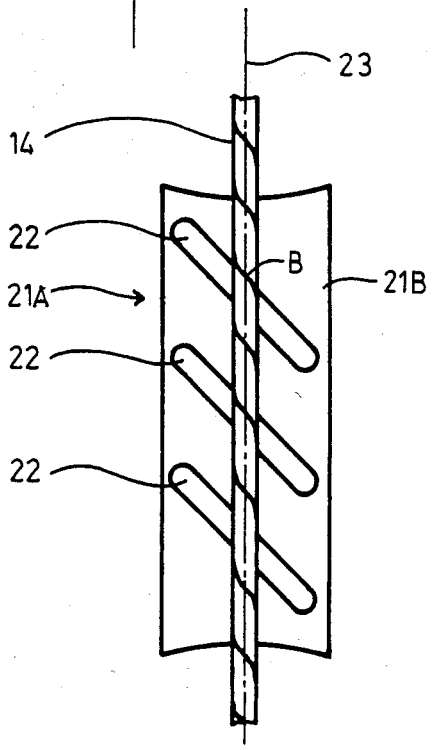
FIG. 4 is a view looking in the direction of the arrow A in FIG. 1 of beads or ridges present in the withdrawal passage or channel of the spinning device for open-end spinning shown in FIG. 1.

Elongated beads or ridges 22 are provided at the interior surface of the withdrawal passage or channel 21. As shown in FIGS. 1 and 4, the beads or ridges 22 extend along the arcuately shaped withdrawal channel section half 21B which faces the center of curvature of the arcuately shaped withdrawal channel section 21A.

The substantially spiral-shaped bead or ridge 17 which is formed at the surface of the substantially conical section 18 of the funnel-shaped withdrawal nozzle 16, as well as the beads or ridges 22 which are formed at the withdrawal channel section half 21B which faces the center of curvature associated with the arcuately shaped withdrawal channel section 21A, respectively extend at an inclination relative to the rotational axis 13 defined by the spinning rotor 12 and the lengthwise axis 23 of the withdrawal passage or channel 21. In other words, the substantially spiral-shaped bead or ridge 17 of the funnel-shaped withdrawal nozzle 16 and the beads or ridges 22 of the withdrawal passage or channel 21 extend at a predetermined inclination relative to the spun yarn 14 which runs through the withdrawal nozzle 16 and the withdrawal passage or channel 21 during the open-end spinning operation.

During the performance of the open-end spinning operation with the inventive spinning device 1, the spinning rotor 12 is rotated at a high rotational speed using the rotary drive means llA. The spun yarn 14 formed thereby is withdrawn through the withdrawal arrangement 15. During this operation, the substantially spiral-shaped bead 17 at the substantially conical portion 18 is contacted by the revolving yarn 14A in a sliding manner.

Figure 3:
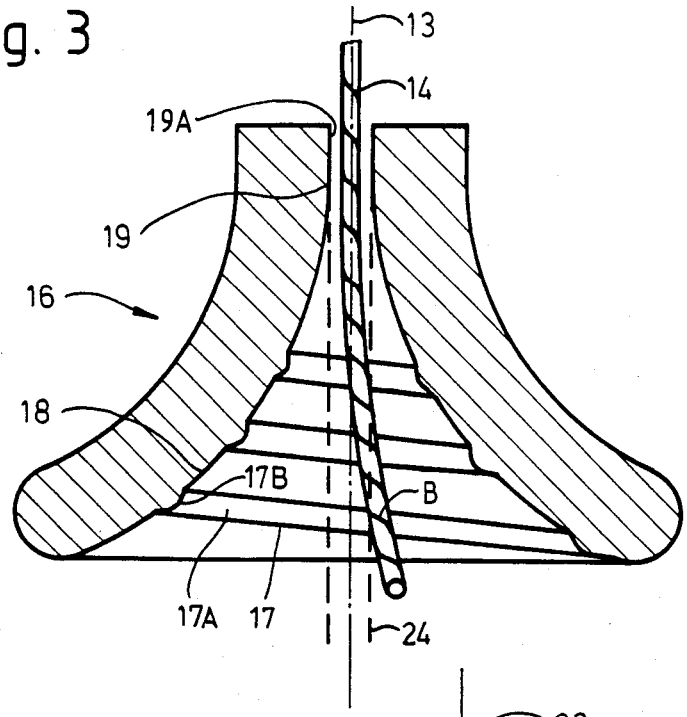
FIG. 3 is a longitudinal cross-section on an enlarged scale through the withdrawal nozzle shown in FIG. 2.

During the open-end spinning operation and depending upon the rotational direction of the spinning rotor 12, the thread or spun yarn 14 or the like is twisted so as to possess a so-called S-twist or Z-twist. In the illustrations of the exemplary embodiment of the inventive spinning device 1, it is assumed that the spun yarn 14 is formed so as to have an S-twist. In such case, the thread or yarn is twisted in the direction indicated by the inclined lines designated by the reference character "B" on the spun yarn 14 as shown in FIGS. 1, 3 and 4. Consequently, the fibers on the side facing the observer, extend in a manner similar to an S-shape whereas such fibers would extend in a manner similar to a Z-shape in the opposite twisting mode. As explained hereinbefore, the substantially spiral-shaped bead or ridge 17 of the conical section 18 in the substantially funnel-shaped withdrawal nozzle 16 as well as the beads or ridges 22 in the withdrawal passage or channel 21 extend at the predetermined inclined disposition as illustrated in FIGS. 3 and 4. During the passage of the thread or yarn in the upward direction illustrated in the drawings, the inclined disposition of the beads or ridges 17 and 22 is such in relation to the fibers, that the beads or ridges 17 and 22 substantially extend in the same direction, i.e. substantially parallel to the twist direction B of the spun yarn 14.

Under these circumstances, the beads 17 and 22 produce an additional twist in the spun yarn 14 which is moving across such beads 17 and 22 in the longitudinal direction of the spun yarn 14. This has the beneficial effect that the spun yarn 14 possesses in the region of the beads or ridges 17 and 22 a higher S-shape twist level or degree of twist than the twist produced by the rotation of the spinning rotor 12. Accordingly, a twist block is formed in the region of the beads or ridges 17 and 22. This twist block disappears, however, after the spun yarn 14 has moved beyond the beads or ridges 17 and 22. Thus, the spun yarn 14 possesses an increased strength in the regions in which the spun yarn is deflected and in which regions the spun yarn 14 is exposed to greatest stresses during the open-end spinning operation.

The aforedescribed formation of a twist block or blockage by means of the inclined disposition of the beads or ridges 17 and 22 in substantially the same direction as the twist direction B of the spun yarn 14, is an essential characteristic or aspect of the present invention and of eminent significance for achieving the initially mentioned advantages of the inventive open-end spinning device 1.

In an advantageous embodiment, as already noted hereinbefore, the substantially funnel-shaped withdrawal nozzle 16 and the substantially spiral-shaped bead or ridge 17 are made of a ceramic material. Such funnel-shaped withdrawal nozzle 16 can be manufactured at low cost if the withdrawal nozzle 16 is formed in such a manner that the ceramic material to be baked is placed in a basic mold and the portion containing the bead or ridge 17 and tubular portion 19 are formed by inserting a correspondingly shaped covering core. When a withdrawal nozzle shape is selected of the type as shown in FIG. 3, the covering core can be readily withdrawn after the baking operation without damaging the withdrawal nozzle 16. Also, the withdrawal nozzle 16 can be readily removed from the basic mold which received the ceramic material prior to the baking step. The possibility of multiple re-use of the basic mold and the covering core is the reason for rendering possible the relatively low-cost production of the withdrawal nozzles 16.

In order that the covering core may be removed from the withdrawal nozzle after the baking step without having to destroy such covering core, two conditions must be fulfilled: Considering the imaginary or virtual cylinder 24 as illustrated in broken lines in FIG. 3, which cylinder 24 extends from the internal surface 19A of the tubular portion 19 of the funnel-shaped withdrawal nozzle 16, the substantially spiral-shaped bead or ridge 17 must be located completely outside this cylinder 24. Furthermore, the surface 17A of the substantially spiral-shaped bead or ridge 17 must contain the partial surface region 17B directed towards the tubular portion 19 such as to converge or narrow towards this tubular portion 19 or, at most, to extend substantially parallel to the imaginary or virtual cylinder 24.

In a further advantageous embodiment of the inventive spinning device 1, the substantially spiral-shaped bead or ridge 17 extends through a predetermined number, preferably in the range of one to three turns, in the form of a single-lead spiral.

A preferred embodiment of the beads or ridges 22 in the twist blocking element 20 is one in which two or three such beads or ridges 22 are provided.

In order to laterally guide the spun yarn 14 at the beads or ridges 22 which are provided at the surface of the arcuately shaped withdrawal passage or channel section half 21B of the twist blocking element 20, it is recommended that these beads or ridges 22 are provided with a concave indentation or recess, specifically such that the beads or ridges 22, as shown in FIG. 4, have their lowest point at the locations where they are covered by the thread or spun yarn 14.

It is also advantageous if the beads or ridges 22 of the twist blocking element 20 are made of ceramic material.

While there are shown and described present preferred embodiments of the invention, it is to be distinctly understood that the invention is not limited thereto, but may be otherwise variously embodied and practiced within the scope of the following claims. ACCORDINGLY,

What we claim is

1. A spinning device for open-end spinning a fiber material infed into said spinning device in order to form a spun yarn, said spinning device comprising:

a spinning rotor receiving the fiber material;

said spinning rotor defining a predetermined rotational axis and being rotatable about said predetermined rotational axis;

rotary drive means for rotating said spinning rotor about said predetermined rotational axis;

said spinning rotor, during an open-end spinning operation, forming a revolving yarn;

a withdrawal arrangement receiving the revolving yarn from said spinning rotor and withdrawing the spun yarn formed during the open-end spinning operation;

said withdrawal arrangement containing a substantially funnel-shaped withdrawal nozzle;

said substantially funnel-shaped withdrawal nozzle possessing a substantially conical portion;

at least one substantially spiral-shaped bead extending about said predetermined rotational axis of said spinning rotor at the substantially conical section of said substantially funnel-shaped withdrawal nozzle and slidingly contacted by said revolving yarn during the open-end spinning operation;

said withdrawal arrangement further containing a twist blocking element;

said twist blocking element possessing a withdrawal channel defining a lengthwise axis and communicating with said substantially funnel-shaped withdrawal nozzle at an end of such substantially funnel-shaped withdrawal nozzle which is disposed remote from said spinning rotor;

at least one bead located in said withdrawal channel and extending at a predetermined inclination relative to said lengthwise axis of said withdrawal channel;

said twist blocking element further containing an arcuately shaped withdrawal channel section of said withdrawal channel and which arcuately shaped withdrawal channel section is associated with a predetermined center of curvature;

said at least one bead located in said withdrawal channel being disposed at the length of an arcuately shaped withdrawal channel section half of said arcuately shaped withdrawal channel section and which withdrawal channel section half faces said predetermined center of curvature;

said spinning rotor, during said open-end spinning operation, forming the spun yarn with a twist in a predetermined twisting direction; and said at least one substantially spiral-shaped bead in said substantially conical portion of said funnel-shaped withdrawal nozzle and said at least one bead located in said arcuately shaped withdrawal channel section of said withdrawal channel, extending at a predetermined inclination relative to the spun yarn and which predetermined inclination substantially extends in the same direction as said predetermined twisting direction of said spun yarn.

2. The spinning device as defined in claim 1, wherein:

said substantially funnel-shaped withdrawal nozzle and said at least one substantially spiral-shaped bead formed in said substantially conical portion of said funnel-shaped withdrawal nozzle, are manufactured from a ceramic material.

3. The spinning device as defined in claim 1, wherein:

said substantially funnel-shaped withdrawal nozzle further possesses a tubular portion defining an internal surface and communicating with said substantially conical portion of said substantially funnel-shaped withdrawal nozzle on the side disposed remote from said spinning rotor;

said internal surface of said tubular portion of said substantially funnel-shaped withdrawal nozzle defining a virtual cylinder extending as a substantially axial extension of said internal surface of said tubular portion through said substantially funnel-shaped withdrawal nozzle;

said at least one substantially spiral-shaped bead being located outside of said virtual cylinder which extends through said substantially conical portion of said substantially funnel-shaped withdrawal nozzle;

said at least one substantially spiral-shaped bead possessing a surface and a partial surface region facing said tubular portion; and said partial surface region being structured such as to narrow in the direction towards said tubular portion.

4. The spinning device as defined in claim 1, wherein:

said substantially funnel-shaped withdrawal nozzle further possesses a tubular portion defining an internal surface and communicating with said substantially conical portion of said substantially funnel-shaped withdrawal nozzle on the side disposed remote from said spinning rotor;

said internal surface of said tubular portion of said substantially funnel-shaped withdrawal nozzle defining a virtual cylinder extending as a substantially axial extension of said internal surface of said tubular portion through said substantially funnel-shaped withdrawal nozzle;

said at least one substantially spiral-shaped bead being located outside of said virtual cylinder which extends through said substantially conical portion of said substantially funnel-shaped withdrawal nozzle;

said at least one substantially spiral-shaped bead possessing a surface and a partial surface region facing said tubular portion; and said partial surface region being structured such as to extend, at the maximum, substantially parallel to said virtual cylinder which extends as said substantially axial extension of said internal surface of said tubular section of said substantially funnel-shaped withdrawal nozzle.

5. The spinning device as defined in claim 1, wherein:

said at least one substantially spiral-shaped bead formed in said substantially conical portion of said substantially funnel-shaped withdrawal nozzle, constituting a single-lead spiral-shaped bead; and said single-lead spiral-shaped bead extending through a predetermined number of turns.

6. The spinning device as defined in claim 5, wherein:

said predetermined number of turns through which said single-lead, substantially spiral-shaped bead extends, is in the range of one to three turns.

7. The spinning device as defined in claim 1, wherein:

pe f 100 said at least one bead located in said withdrawal channel formed in said twist blocking element, constitutes a maximum of three series-arranged beads.

8. The spinning device as defined in claim 1, wherein:

said at least one bead located in said withdrawal channel formed in said twist blocking element, containing a substantially concavely-shaped indentation;

said substantially concavely-shaped indentation laterally guiding the spun yarn during the open-end spinning operation of the spinning device.

9. The spinning device as defined in claim 1, wherein:

said at least one bead located in said withdrawal channel formed in said twist blocking element, being manufactured from a ceramic material.

* * * * *

UNITED STATES PATENT AND TRADEMARK OFFICE

CERTIFICATE OF CORRECTION

PATENT NO. : 4,665,687

DATED : May 19, 1987

INVENTOR(S) : ERNST OTT and CHRISTOPH KURATLE

It is certified that error appears in the above-identified patent and that said Letters Patent is hereby corrected as shown below:

Claim 7, line 2, please delete "pe f 100"

Signed and Sealed this

Twenty-seventh Day of October, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,665,687

DATED : May 19, 1987

INVENTOR(S) : ERNST OTT and CHRISTOPH KURATLE

It is certified that error appears in the above—identified patent and that said Letters Patent is hereby corrected as shown below:

On the title page, as regards the priority date, please delete "October 10, 1985" and insert --October 15, 1985--

Signed and Sealed this

Twenty-seventh Day of September, 1988

*Attest:*

DONALD J. QUIGG

*Attesting Officer*

*Commissioner of Patents and Trademarks*